United States Patent [19]

Huckestein

[11] Patent Number: 5,033,362

[45] Date of Patent: Jul. 23, 1991

[54] AIR DISTRIBUTION OUTLET

[75] Inventor: James E. Huckestein, Gibsonia, Pa.

[73] Assignee: James E. Huckestein Inc., Pittsburgh, Pa.

[21] Appl. No.: 574,803

[22] Filed: Aug. 30, 1990

[51] Int. Cl.[5] ..... F24F 13/065

[52] U.S. Cl. ..... 98/41.1; 98/40.01

[58] Field of Search ..... 98/41.1, 41.2, 40.01, 98/40.11, 40.19

[56] References Cited

U.S. PATENT DOCUMENTS

| | | | |
|---|---|---|---|
| 1,319,526 | 10/1919 | Hauser | 98/41.2 |
| 2,315,154 | 3/1943 | Fenner | 98/40.01 |
| 2,718,712 | 9/1955 | Bruker et al. | 98/40.01 X |
| 3,342,212 | 9/1967 | Day et al. | 98/41.1 X |
| 3,537,380 | 11/1970 | Spradling et al. | 98/40.11 |

FOREIGN PATENT DOCUMENTS

| | | | |
|---|---|---|---|
| 172858 | 7/1988 | Japan | 98/40.11 |

*Primary Examiner*—Harold Joyce

*Attorney, Agent, or Firm*—Carothers & Carothers

[57] ABSTRACT

An air distribution outlet device is provided having an elongated barrel with an inlet at the top end and a closure at the bottom end. A longitudinally extending wall portion of this barrel is formed with a multiplicity of orifices around the entire periphery for a predetermined axial length thereby permitting transverse outflow of air from the barrel. A flow-control deflector valve is disposed in this intermediate perforated portion of the barrel intermediate the extremes of the axial length of the perforations thereof and this valve is selectively adjustable between a position which is substantially blocking air flow therebelow to a position substantially unrestrictive to the flow of air through the entire perforated portion. This deflector valve may be selectively positioned at any position between the extremes thereby permitting control of the air flow in an upward or downward direction as desired as it is being diffused transversely through the perforations in the barrel. In order to further enhance this control of lateral air distribution, the barrel is provided with means for rotating it about its longitudinal axis.

3 Claims, 1 Drawing Sheet

AIR DISTRIBUTION OUTLET

BACKGROUND OF THE INVENTION

The present invention relates generally to an air distribution outlet device for cooling and heating systems, and more particularly to a terminal duct diffuser.

In the heating and cooling of large buildings, such as factories and the like, air distribution ducts having outlets at selected or desired work stations are installed throughout the plant and a source of air at a predetermined temperature is forced through the ducts and is then distributed at the selected work stations by various types of terminal duct diffusers or air distribution outlets.

It is the function of these terminal air distribution outlets to distribute the air for all of the varied operating conditions that may be encountered at a particular work station wherein it is desirable to control direction, volume and air distribution pattern for worker comfort. A typical prior art air distribution outlet device is disclosed in U.S. Pat. No. 3,919,929 which issued on Nov. 18, 1975 to William M. Harman for MULTIPLE-CONTROL AIR DISTRIBUTION OUTLET DEVICE.

This prior art air distribution outlet device incorporates an elongated, perforated-wall barrel . One end of this perforated elongated barrel is connected to an air distribution duct and the bottom end of this perforated barrel is provided with a flow control valve which may be selectively opened and closed, such that in its wide open position good deal of the air entering the elongated perforated barrel will flow directly therethrough and down out through the bottom flow control valve to direct air flow on the work station positioned below. This prior art device is in addition provided with a butterfly type choke valve that is positioned in the barrel above the perforated section or portion thereof. This is a flow control valve positioned upstream from the perforated barrel and controls the volumetric flow of the air into the perforated barrel section lying there below.

In addition, the elongated barrel section is also mounted for a swiveling movement in any direction to selectively position the device to direct a desired pattern of air distribution.

This prior art air distribution outlet device is effective, but inherently has undersirable limitations in that the means to selectively direct the volumetric control of air flow in a lateral direction is extremely limited and it is a relatively expensive device to manufacture due to its ability to swivel in all directions and further due to the further added complexity of the bottom flow control valve. In addition, when the bottom control valve thereof is open, the air flow is directed to the area immediately positioned therebelow and as this bottom control valve is further opened, the area immediately below is subjected to more and more direct blasts of forced air without appropriate diffusion.

It is a principal object of the present invention to eliminate these disadvantages.

SUMMARY OF THE INVENTION

The terminal duct diffuser or air distribution outlet device of the present invention in general comprises an elongated barrel having a top end and a closed bottom end with an air inlet at the top, and an intermediate portion of this barrel wall is provided with a multiplicity of orifices around the entire periphery for a predetermined axial length to thereby permit transverse outflow of air from this barrel. The inlet of the barrel is connected to a source of air under pressure in a conventional manner.

A flow control deflector valve is disposed in the intermediate perforated portion of the barrel and is positioned intermediate the extremes of the predetermined axial length of this perforated portion of the barrel. This deflector valve is selectively adjustable between a position substantially blocking air flow therebelow to a position which is substantially unrestrictive to the flow of air therebelow in this intermediate perforated portion.

Accordingly, when this flow control deflector valve is in its fully closed position, all of the air flowing into this perforated barrel section will be forced to be diffused latteraly outward through the multiplicity of orifices in the perforated intermediate section of the barrel which lies above the closed deflector valve.

When the deflector valve is in its fully opened or verticle position, then the air under pressure is also permitted to flow past the deflector valve so that the entire perforated barrel permits latteral flow of the air under pressure therethrough, even in that area which lies below the deflector valve.

Thus, when the damper or deflector valve is in its fully closed position, the air flow is delivered through the upper portion of this perforated barrel lying above the damper or deflector valve and it is transversely permitted to flow outward through these perforations at its maximum velocity. When this damper or deflector valve is in its fully opened verticle position, then the air entering the perforated barrel section is permitted to flow transversely through all of the orifices, even those lying below the deflector valve, thereby delivering the air under pressure at a decreased velocity in the transverse direction, say for example, 50% of the air velocity which would otherwise be delivered transversely through the upper portion of the perforated barrel when the damper or deflector valve is closed.

Any intermediate position of this damper or diffuser valve may be selected between fully opened and fully closed to thereby provide any intermediate desired air flow velocity and to thereby also permit this damper or deflector valve to be positioned to deflect the air flow transversely traveling through the perforations or orifices of the perforated barrel section such that it may be directed more predominately upward or downward when laterally exiting the perforated barrel section, to thereby more preferentially distribute the lateral air flow while still diffusing the same for worker comfort control.

In order to further enhance this lateral distribution feature of the air distribution outlet device of the present invention, the barrel section is also provided with means to permit rotation thereof about its axis.

Accordingly, the combination perforated barrel section and damper or deflector valve of the present invention permits one to not only adjust the air velocity, but further permits greater lateral directional control of the air flow as it is being diffused transversely through the perforation in an upward or downward direction. In addition, the simplicity of the outlet distribution outlet device of the present invention is such that it permits inexpensive construction.

Also, by providing means within the perforated barrel section to control the lateral distribution of the air flow in an upward or more downward direction, this eliminates the requirement of having a flow control valve at the bottom of the barrel section and thereby also eliminates a situation where the air under pressure is forced directly downward onto any objects or persons positioned directly therebelow, thereby subjecting them with direct blasts of undiffused air.

BRIEF DESCRIPTION OF THE DRAWINGS

Other objects and advantages appear in the following description and claims.

The accompanying drawings show, the purpose of exemplification without limiting the invention or the claims thereto, certain practical embodiments illustrating the principals of this invention wherein:

DETAILED DESCRIPTION OF THE ILLUSTRATED EMBODIMENTS

Figure 1:
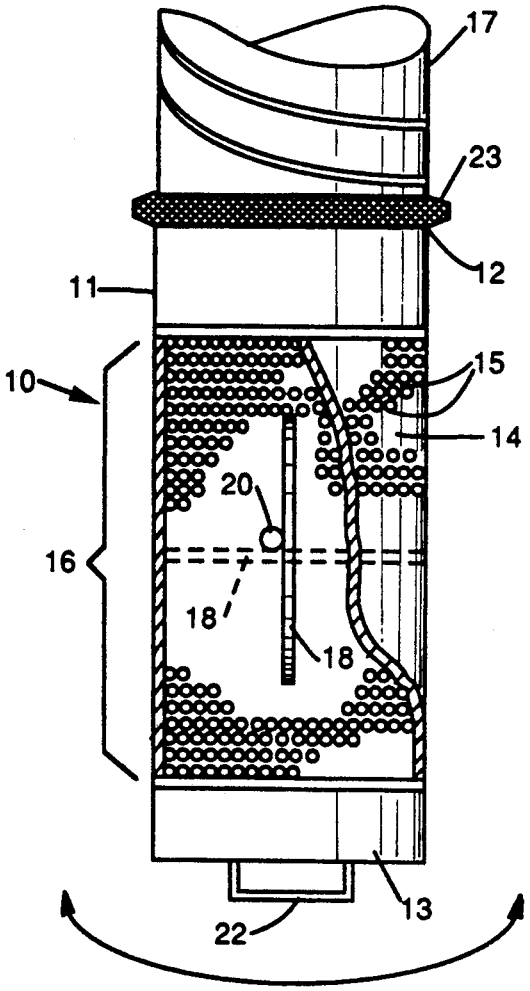
FIG. 1 is a diagramatic elevational view of an air distribution outlet device shown in partial section and emboding the principals of the present invention.
Figure 2:
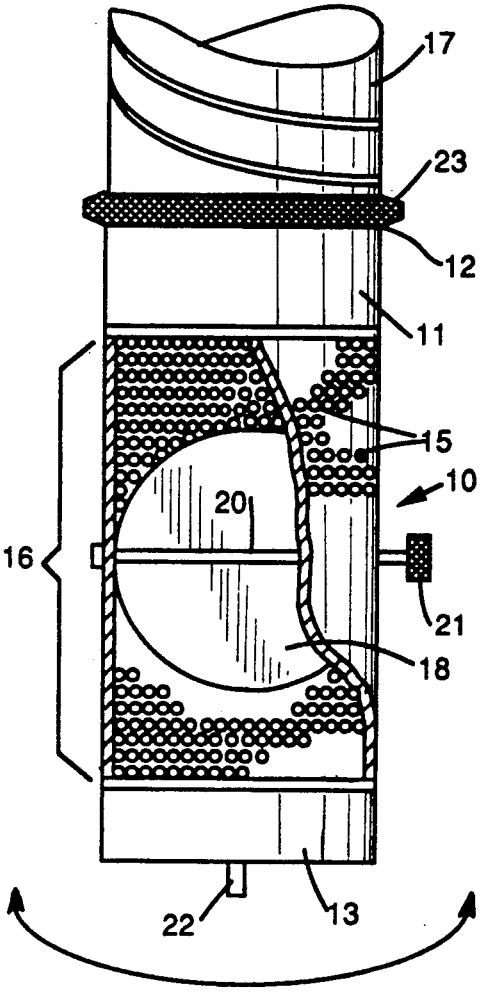
FIG. 2 is a view in side elevation of the air distribution outlet device shown in FIG. 1 with portions thereof removed for enhanced internal viewing.

Referring to the drawings, the air distribution outlet device 10 of the present invention is comprised of an elongated barrel 11 having opposed top and bottom ends 12 and 13 respectively. Annular top end 12 provides an inlet and bottom end 13 provides a closure.

An intermediate, longitudinally extending wall portion 14 is formed with a multiplicity or orifices or perforations 15 around the entire periphery thereof for a predetermined axial length 16 thereby permitting transverse outflow of air from the barrel 11.

The inlet end 12 of barrel 11 is connected to a source of air under pressure (not shown) through conventional spiral supply air ductwork 17.

Flow control deflector or damper valve 18 is disposed in the intermediate portion of the perforated barrel section 14 and it is positioned intermediate the extremes of the predetermined axial length 16. This valve 18 is shown in the form of a conventional butterfly damper valve and is shown in the figures in its fully opened verticle position and is additionally illustrated in FIG. 1 in its fully closed position 18'. Accordingly, damper or deflector valve 18 is welded to its shaft 20, which shaft 20 is inturn pivotally mounted at its opposite ends to barrel section 14, and the entire circular plate of valve 18 may be rotated by turning knob 21, as knob 21 is rigidly secured to shaft 20.

Shaft 20 is mounted into barrel portion 14 with resistance so that when valve 18 is rotated in either direction by knob 21, one may selectively adjust valve 18 to any position between the position fully opened and fully closed to accordingly more appropriately direct the transverse flow of air outwardly through the perforations or orifices 15 of the barrel portion 14 to more readily direct the transverse flow in either an upward or downward direction. In order to even further enhance this directional ability of the diffused air, the bottom closure 13 is also provided with handle 22 to permit rotation of barrel 11 as indicated by the arrow. Barrel 11 is permitted to rotate within the slip connection of spiral connector nylon threaded nut 23.

Accordingly, it may be readily observed that by positioning deflector valve 18 in any intermediate position the air flow will be directed more to one side of the perforated barrel section 14 than the other and it can also be directed in a more upwardly direction or a more downwardly direction and this directed and diffused air may be further selectively positioned to provide optimum air distribution for worker comfort by rotating the entire barrel unit 11 thereby providing an optimum air distribution pattern.

In addition, as previously explained, by selecting the closure position of the deflector valve 18, one can also readily vary the velocity of the air under pressure which is exiting transversely through the diffuser orifices 15 of the perforated barrel section or portion 14.

I claim:

1. An air distribution outlet device comprising: an elongated barrel having opposed top and bottom ends with an air inlet at said top end and a closure at said bottom end and an intermediate, longitudinally extending wall portion formed with a multiplicity of orifices around the entire periphery for a predetermined axial length permitting transverse outflow of air from said barrel, and means for connecting said inlet end to a source of air under pressure; the improvement including a flow control deflector valve disposed in said intermediate portion of said barrel intermediate the extremes of said predetermined axial length and being comprised of damper plate means mounted transversely in said intermediate portion of said barrel and being substantially coextensive with the area of said intermediate portion of said barrel, and at least portions of said plate means being transversely pivotal to selectively adjust the directional flow of air therebelow in said perforated barrel.

2. An air distribution outlet device according to claim 1 wherein said damper plate means being pivotally mounted in said intermediate portion of said barrel for rotation about an axis extending in the plane of said damper plate means and transversely to the longitudinal axis of said barrel, said damper plate means being substantially coextensive with the area of said intermediate portion of said barrel and pivotable between a position transverse to the longitudinal axis of said barrel and a position aligned with the longitudinal axis.

3. An air distribution outlet device according to claim 1 including means for rotating said barrel about the longitudinal axis thereof.

* * * * *